United States Patent [19]

Kageyama et al.

[11] 4,403,691

[45] Sep. 13, 1983

[54] SPARE LEAD HOLDER

[75] Inventors: Hidehei Kageyama; Takahiko Suzuki, both of Kawagoe, Japan

[73] Assignee: Kotobuki & Co., Ltd., Kyoto, Japan

[21] Appl. No.: 215,312

[22] Filed: Dec. 11, 1980

[30] Foreign Application Priority Data

May 9, 1980 [JP] Japan ..... 55-063437
Nov. 12, 1980 [JP] Japan ..... 55-161706

[51] Int. Cl.[3] ..... A45C 11/34

[52] U.S. Cl. ..... 206/214; 206/443; 206/538; 221/263; 401/89

[58] Field of Search ..... 206/214, 224, 443, 229, 206/534, 540, 528, 530, 534.2, 538, 539, 533; 221/263; 401/89

[56] References Cited

U.S. PATENT DOCUMENTS

| | | | |
|---|---|---|---|
| 687,358 | 11/1901 | Whitehead | 206/540 |
| 1,741,033 | 12/1929 | Neidlinger | 221/263 |
| 3,313,441 | 4/1967 | Zadden | 206/540 |
| 3,561,592 | 2/1971 | McCool | 206/534 |
| 3,601,250 | 8/1971 | Merila | 206/540 |
| 3,860,111 | 1/1975 | Thompson | 206/540 |

FOREIGN PATENT DOCUMENTS

| | | | |
|---|---|---|---|
| 663832 | 11/1965 | Belgium | 221/263 |
| 795644 | 10/1968 | Canada | 206/540 |
| 1097353 | 1/1961 | Fed. Rep. of Germany | 206/540 |
| 1098150 | 5/1955 | France | 221/263 |
| 1328990 | 4/1963 | France | 221/263 |

*Primary Examiner*—Joseph Man-Fu Moy
*Attorney, Agent, or Firm*—Bernard, Rothwell & Brown

[57] ABSTRACT

A holder for spare lead comprises a hollow cylindrical holder body, said holder having an open end portion and a longitudinal groove formed on the inner wall along the axial direction of the holder body for locating only a suitable number of leads to a position from which the leads are taken out, and a cap body frictionally and rotatably mounted on the one end portion of the holder body. The cap body has an opening to dispense the spare lead from the groove.

9 Claims, 32 Drawing Figures

SPARE LEAD HOLDER

BACKGROUND OF THE INVENTION

1. Field of the Invention

This invention related to an improvement of a holder for containing spare leads employed in a mechanical pencil, drawing instrument and the like.

2. Description of the Prior Art

In general, a holder for containing spare leads (hereinafter referred to simply as "spare lead holder") heretofore known has a simple and small cylindrical or the like shape. However there is such an inconvenience in this simple shape and construction of spare lead holder that when a user takes off a cap from its holder body and tilts the body in order to take out a desired number of leads (or a lead), undesired number of or all the spare leads which had been contained in the holder slides out therefrom.

SUMMARY OF THE INVENTION

In contrast, it is an object of the invention to provide a construction of the spare lead holder by which a suitable number of leads (a lead) can arbitrarily be taken out.

This object is achieved in accodance with the invention with the construction of the spare lead holder which comprises a holder body for containing spare leads having a groove formed on the inner wall along the axial direction of the holder body for locating only a suitable number of leads separated from the remaining leads contained in the other part of the holder body to a position through which the leads are taken out, and a cap body, on the top surface of which an opening for taking out the leads is correspondingly provided to the groove of the holder body; said holder body and cap body having means for limiting relative rotational motion of the cap body to the holder body to a certain extent of its rotational angle, and both the bodies being frictionally combined with each other in a rotatable manner.

A more specified embodiment of the invention provides a construction of the spare lead holder which comprises a holder body having a longitudinal groove on the inner wall thereof and a notch provided on the outer circumference of the open end portion of the holder body at a point symmetry position to the longitudinal groove, and a cap body, on the top surface of which an opening for taking out leads is correspondingly provided to the groove of the holder body, further a projection projecting towards the inside of the cap body for rotatably locating the cap body within the aforesaid notch being provided at the vicinity of the end of a fitting portion of the cap body.

An alternative embodiment of the invention provides a construction of the spare lead holder which comprises a holder body having a longitudinal groove on the inner wall thereof and a notch provided on the outer circumference of the open end portion of the holder body at a point symmetry position to the longitudinal groove, and a cap body on the top surface of which an opening for taking out leads is correspondingly provided to the groove of the holder body, and further the cap body having protruding portion beyond the bottom circumference of the cap body for rotatably locating the cap body within the aforesaid notch and being provided at the vicinity of the end of a fitting portion of the cap body.

A further alternative embodiment of the invention provides a construction of the spare lead holder which comprises a holder body having a longitudinal groove on the inner wall thereof, and a cap body on the top surface of which a slightly outwardly protruded narrow hollow portion for taking out leads is correspondingly provided to the longitudinal groove of the holder body; further the holder body and cap body being provided with rotation control members, i.e., a groove along axial direction, stopper for rotation, a stopper along axial direction, and a groove frictionally engaging with the latter stopper respectively, in order to control mutual rotation between the holder body and cap body.

The features of novelty, which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

FIG. 2(*b*) is a sectional view taken along line A—A of FIG. 1;

FIG. 2(*c*) is a sectional view taken along line B—B of FIG. 1;

FIG. 4(*b*) is a left side view of the spare lead holder in FIG. 3;

FIG. 4(*c*) is a sectional view taken along line A—A of FIG. 3;

FIG. 6(*b*) is a sectional view taken along line A—A in FIG. 6(*a*);

FIG. 6(*c*) is a left side view of the holder body in FIG. 6(*a*);

FIG. 6(*d*) is a longitudinal sectional view showing a cap body for fitting with the holder body illustrated in FIG. 6(*a*);

FIG. 6(*e*) is a right side view of the cap body in FIG. 6(*d*);

FIG. 6(*f*) is a left side view of the cap body of FIG. 6(*d*);

FIGS. 7(*b*), 8(*b*), 9(*b*), and 10(*b*) are left side views each showing the holder body of FIGS. 7(*a*), 8(*a*), 9(*a*), and 10(*a*), respectively;

FIGS. 7(*c*), 8(*c*), 9(*c*), and 10(*c*) are longitudinal sectional views each showing another embodiment of a cap body in accordance with the invention, respectively;

FIGS. 7(*d*), 8(*d*), 9(*d*), and 10(*d*) are right side views each showing the cap body of FIGS. 7(*c*), 8(*c*), 9(*c*), and 10(*c*), respectively.

DESCRIPTION OF THE PREFERRED EMBODIMENTS

Figure 1:
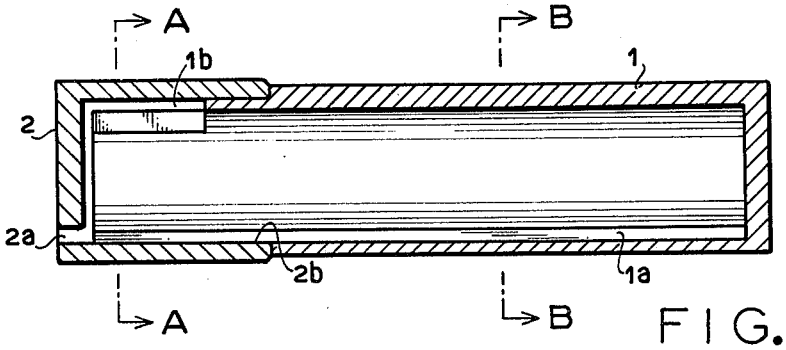
FIG. 1 is a longitudinal sectional view showing one embodiment of a spare lead holder in accordance with the present invention.
Figure 2A:
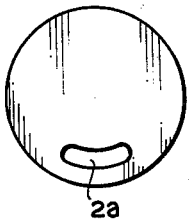
FIG. 2 (*a*) is a left side view of the spare lead holder in FIG. 1.
Figure 2B:
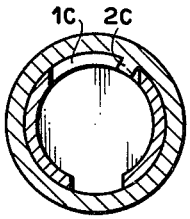
Figure 2C:
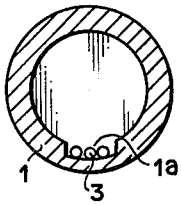

In FIG. 1 being a longitudinal sectional view which shows one preferred embodiment of a spare lead holder in accordance with the present invention, FIG. 2(*a*) being a left side view, FIG. 2(*b*) being a sectional view taken along line A—A, and FIG. 2(*c*) being a sectional view taken along line B—B of FIG. 1, respectively, a long groove 1*a* is formed on the inner wall of a holder body 1 for containing leads along the axial direction thereof, and a notch 1*c* is provided on the outer circumference of the open end 1*b* of the holder body 1 at a point symmetry position to the long or longitudinal groove 1*a*. On the other hand, an opening 2*a* for taking out leads (a lead) is provided on the top surface of a cap body 2 at the position corresponding to that of the aforesaid longitudinal groove 1*a*, and further a projection 2*c* projecting towards the inside of the cap body 2 for rotatably locating the cap body within the aforesaid notch is formed at the vicinity of the end of a fitting portion 2*b* of the cap body 2. The cap body 2 thus constructed is frictionally fitted to the holder body 1.

Since the spare lead holder of the present invention is constructed as described above, when spare leads 3 were previously contained in the holder body 1, the leads 3 to be taken out on the next occasion are generally separated from the remaining leads and disposed in the longitudinal groove 1*a*. In case of employing the spare lead holder, when a user rotates the cap body 2 with respect to the holder body 1, the projection 2*c* is defined by the notch 1*c* in such that the opening 2*a* for taking out leads of the cap body 2 is correspondingly located to the longitudinal groove 1*a* of the holder body 1. Accordingly, when user tilts the spare lead holder in the above situation, only a suitable few leads which have been contained in the longitudinal groove 1*a* of the holder body 1 can easily be taken out through the opening 2*a* of the cap body 2.

Figure 3:
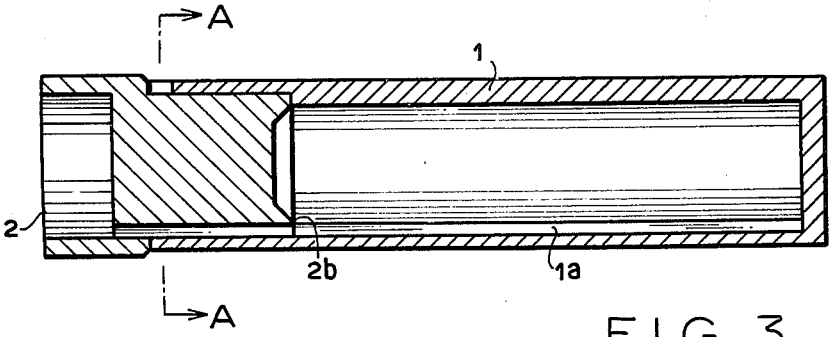
FIG. 3 is a longitudinal sectional view showing another embodiment of a spare lead holder according to the invention.
Figure 4A:
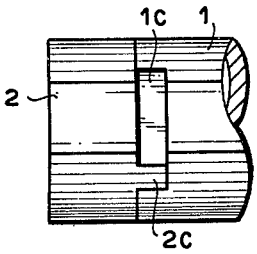
FIG. 4(*a*) is a front view illustrating an essential part of the spare lead holder in FIG. 3.
Figure 4B:
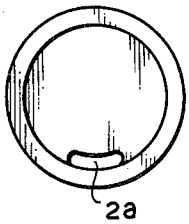
Figure 4C:
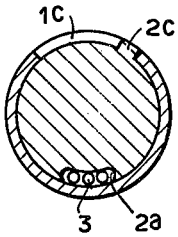

FIG. 3 is a longitudinal sectional view showing another embodiment of a spare lead holder according to the invention, FIG. 4(*a*) is a front view showing an essential part of the spare lead holder, FIG. 4(*b*) is a left side view, and FIG. 4(*c*) is a sectional view taken along line A—A of FIG. 3 in which a longitudinal groove 1*a* is formed on the inner wall of a holder body 1 for containing leads along the axial direction thereof, and a notch 1*c* is provided on the outer circumference of the open end 1*b* of the holder body 1 at a point symmetry position to the long or longitudinal groove 1*a*.

On the other hand, an opening 2*a* for taking out leads (a lead) is provided on the top surface of a cap body 2 at the position corresponding to that of the aforesaid longitudinal groove 1*a*, and further a protruding portion 2*c* beyond the bottom circumference of the cap body 2 for rotatably locating the cap body 2 within the aforesaid notch 1*c* of the holder body 1 is provided at the vicinity of the end of a fitting portion 2*b* of the cap body 2. The cap body 2 thus arranged is frictionally fitted to the inner wall of the holder body 1 to construct the spare lead holder. Accordingly, in this embodiment, since the structure of the cap body 2 is fitted to the inside of the holder body 1, the protruding portion 2*c* is formed so as to be beyond the bottom circumference of the cap body 2. The operations for taking suitable leads out are quite same as those in the first embodiment shown in FIG. 1 and FIGS. 2(*a*), (*b*), (*c*), and furthermore the advantageous effects thereof are also same as those in the first embodiment. In this case it is not necessarily required that a relative position of the protruding portion 2*c* to the opening 2*a* for taking out leads in the cap body 2 is located to its point symmetry position in the case where the aforesaid relative position is substantially corresponding to that of the notch 1*c* to the longitudinal groove 1*a* in the holder body 1.

As described above, operations for taking out spare leads (a lead) can easily be carried out by means of the spare lead holder according to the invention, furthermore a convenient spare lead holder having a simple construction can be fabricated in accordance with the invention and therefore the practical advantages thereof are remarkable.

Figure 5:
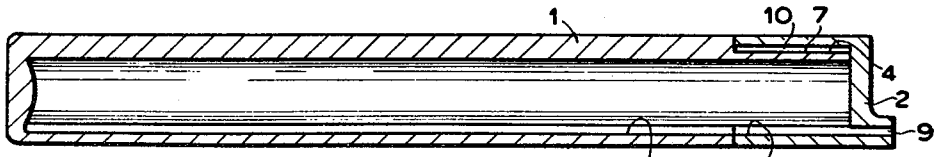
FIG. 5 is a longitudinal sectional view showing a further embodiment of a spare lead holder in accordance with the invention.
Figure 6A:
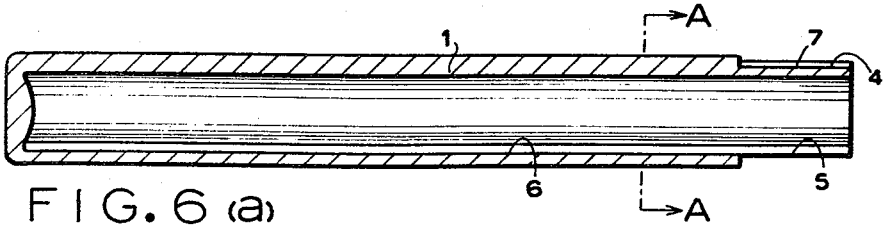
FIG. 6(*a*) is a longitudinal sectional view showing an embodiment of a holder body according to the invention.
Figure 6B:
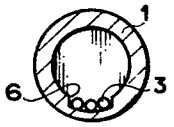
Figure 6C:
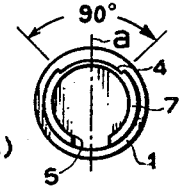
Figure 6D:
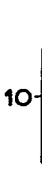
Figure 6E:
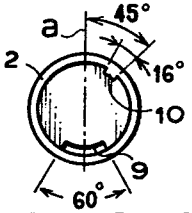
Figure 6F:
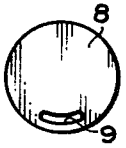
Figure 7D:
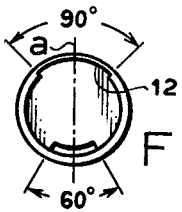
FIGS. 7(*a*), 8(*a*), 9(*a*), and 10(*a*) are longitudinal sectional views each showing another embodiment of a holder body according to the invention, respectively.
Figure 7C:
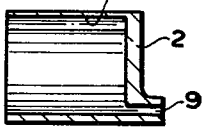
Figure 7B:
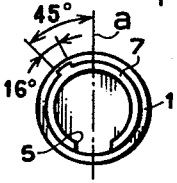
Figure 7A:
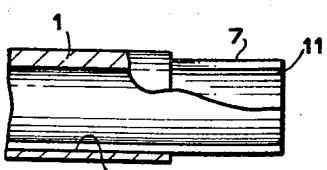
Figure 8A:
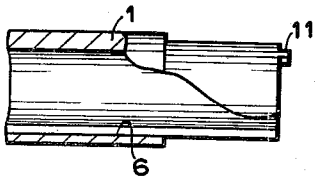
Figure 8B:
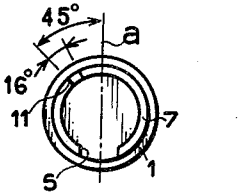
Figure 8C:
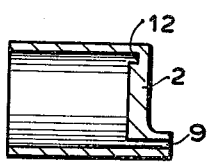
Figure 8D:
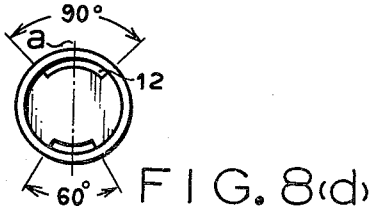
Figure 9A:
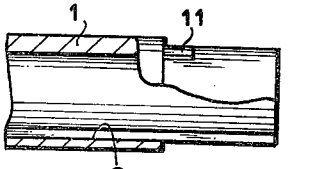
Figure 9B:
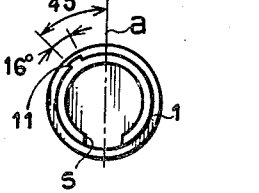
Figure 9C:
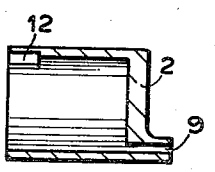
Figure 9D:
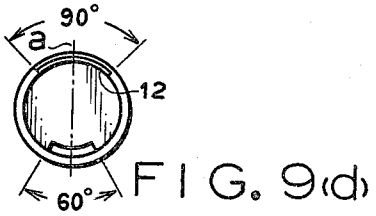
Figure 10A:
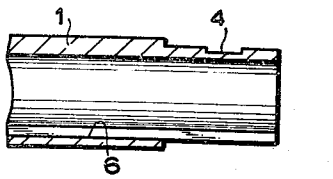
FIG. 10(*e*) is a front view of the holder body shown in FIG. 10(*a*).
Figure 10B:
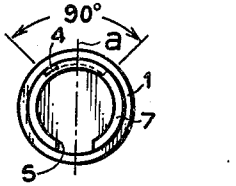
Figure 10C:
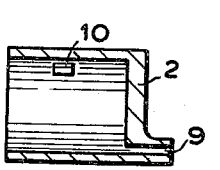
Figure 10D:
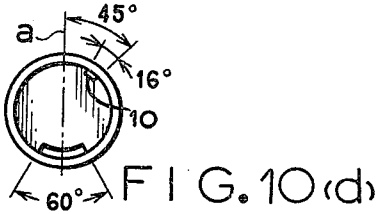
Figure 10E:
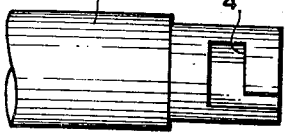

FIG. 5 is a longitudinal sectional view showing a further preferred embodiment of a spare lead holder in accordance with the invention which comprises a holder body 1 for containing a plurality of leads, and a cap body 2 fitted detachably with and rotatably to the end portion of the holder body 1.

As shown in FIGS. 6(*a*), (*b*) and (*c*), the holder body 1 is formed in a hollow cylindrical shape and one end of which is opened, and a fitting portion 7 which is the open end portion having a smaller diameter than that of the remaining portion of the holder body 1 is further formed. On the periphery of the fitting portion 7, a groove 4 is formed along its axial direction within an extent of angle 45° in left and right directions from a basic line a, and further a notch 5 extending along the axial direction is provided on a portion of the open end of the fitting portion 7 at the position opposed to the groove 4. Then, when the notch 5 is communicatively fitted with a long or longitudinal groove 6 extending along the axial direction of the holder body 1 and formed on the inner wall thereof, a suitable number of leads 3 are separated from those contained previously in the holder body 1 and contained in the longitudinal groove 6.

On the other hand, as shown in FIGS. 6(*d*), (*e*) and (*f*), on the top surface 8 of the cap body 2, a slightly outwardly protruded narrow hollow portion 9 for taking out leads (a lead) is formed and which is placed opposedly to that of the longitudinal groove 6 in the same direction therewith within an extent of angle 30° in left and right directions from a basic line a. Furthermore a stopper 10 for rotation is protruded on the inner wall of the cap body 2 at a position near to the bottom end thereof being a fitting portion with the holder body 1. The stopper 10 is formed at the position with angle 45° from the basic line a, and this stopper 10 engages with the groove 4 in the fitting portion 7 in frictional state at the time when the cap body 2 fits with the holder body 1, whereby the stopper 10 functions as a stopper for restricting a rotational extent of the cap body 2 to the extent of angle 45° in left and right directions from the basic line a.

In the case when a user wishes to supplement new leads 3 to the holder body 1 or substitute the leads therein by new ones 3, the user may pull out the cap body 2 along the axial direction, so that the cap body 2 can easily be separated from the holder body 1.

In accordance with the construction of the spare lead holder as described above, when the leads 3 are previously contained in the holder body 1, the leads 3 to be taken out on the next occasion are separately contained in the longitudinal groove 6 of the holder body 1 from the remaining leads. In this situation, when the cap body 2 is rotated with a prescribed angle, the stopper 10 is defined by the groove 4, so that the protruded hollow portion 9 for taking out leads and the longitudinal groove 6 are automatically located in place each other. Thus, when the user tilts the spare lead holder in this condition, suitable number of the leads 3 previously contained in the longitudinal groove 6 can easily be taken out through the protruded narrow hollow portion 9. In this case, since the protruded narrow hollow portion 9 extends outwardly in the same direction with that of the longitudinal groove 6, the leads (lead) 3 can smoothly be taken out along the longitudinal groove 6, so that there is no fear of breaking the leads, because no unnatural inclination of the leads (lead) 3 occurs at the time of taking out the leads (or lead). Moreover even in such a case where the holder body 1 and cap body 2 are colored with the same color, a user can easily find out a place where a lead (leads) is (are) to be taken out, because the narrow hollow portion 9 is slightly projected from the other part of the top level in the cap body 2. In addition, since the stopper 10 engages with the groove 4 in frictional state, when a user may arbitrarily rotate the cap body 2 within its rotational extent and tilts the spare lead holder in this condition, a suitable (one to several) number of lead (or leads) contained in the longitudinal groove 6 separately from the other leads in the holder body 1 can easily be taken out.

FIGS. 7(*a*) and (*b*) show a still further embodiment of a spare lead holder of the invention in which a stopper 11 extending along the axial direction of the aforesaid holder body 1 is protrusively formed on the outer wall of the fitting portion 7 of the holder body 1 and on the other hand, a groove 12 for frictionally engaging with the stopper 11 is formed on the inner wall surface of the aforesaid cap body 2 along the periphery thereof.

FIGS. 8(*a*) and (*b*) show still another embodiment of a spare lead holder of the invention in which a stopper 11 is protruded on the wall in the front end portion of the fitting portion 7 of the aforesaid holder body 1 along the axial direction thereof and on the other hand, a groove 12 for frictionally engaging with the stopper 11 is provided on the top wall 8 of the aforesaid cap body 2 along the periphery thereof.

FIGS. 9(*a*) through (*d*), inclusive, show an yet still further embodiment of a spare lead holder of the invention in which a stopper 11 extending shortly along the axial direction of the aforesaid holder body 1 is protrusively formed on the rear end portion of the fitting portion 7 in the holder body 1 and on the other hand, a groove 12 for frictionally engaging with the stopper 11 is formed on the inner wall of the rear end portion of the aforesaid cap body 2 along the circumferential surface thereof.

FIGS. 10(*a*) through (*e*) show an yet still another embodiment of a spare lead holder in accordance with the invention in which a groove 4 extending shortly along the axial direction of the aforesaid holder body 1 is formed on a portion of the periphery of the fitting portion 7 of the holder body 1 and on the other hand, a stopper 10 is inwardly protruded on a portion of the aforesaid cap body 2.

As described above, the modified spare lead holders according to this invention have further such an advantage that there is no fear of breaking leads (or a lead) to be taken out at the time of the operation therefor in addition to the advantages attained by the above first and second embodiments of the present invention.

Furthermore it is to be noted that the invention is not limited to the above-mentioned preferred embodiments, but various modifications and changes may be applied to the groove 4 and stopper 11 in the fitting portion 3 of the holder body 1 as well as the protruded narrow hollow portion 9, stopper 10 and groove 12 of the cap body 2 irrespective of an angle from its basic line a so far as the combination of the holder body 1 and cap body 2 is utilizable as a spare lead holder.

What is claimed is:

1. A spare lead holder which comprises a hollow cylindrical holder body for containing spare leads, said holder having an open end portion and having a longitudinal groove formed on the inner wall along the axial direction of said holder body for locating only a suitable number of leads to a position from which said leads are taken out, and a cap body frictionally and rotatably mounted on said one end portion of said holder body, said cap body having on the top surface thereof an opening for taking out said leads; said holder body and said cap body having means for limiting rotational motion of said cap body relative to said holder body in one direction of rotation of said cap body to a position in which said opening is aligned with said groove whereby only the spare leads within said groove are accessible through said opening.

2. A spare lead holder as claimed in claim 1 wherein said holder body has a longitudinal groove on the inner wall thereof and a notch provided on the outer circumference of the open end portion of said holder body at a point symmetry position to said longitudinal groove, said cap body, on the top surface of which said opening is correspondingly provided to said longitudinal groove of the holder body, and a protruding portion beyond the bottom circumference of said cap body for rotatably locating said cap body within said notch of the holder body is further provided at the vicinity of the end of a fitting portion of said cap body.

3. A spare lead holder as claimed in claim 1 wherein said holder body has a fitting portion formed on the open end thereof, a longitudinal groove on the inner wall thereof, and a notch extending along the axial direction thereof being provided on an open end portion of said fitting portion at the position opposed to said longitudinal groove; said cap body, on the top surface of which a slightly outwardly protruded narrow hollow portion for taking out leads is correspondingly provided to said longitudinal groove of the holder body; and both said holder and cap bodies are provided with rotation control members for controlling mutual rotation therebetween.

4. A spare lead holder as claimed in claim 3 wherein said rotation control members are a groove being formed along the axial direction of said fitting portion, and a stopper for rotation being protruded on the inner wall of said cap body at a position near to the bottom end thereof being a fitting portion with said holder body.

5. A spare lead holder as claimed in claim 3 wherein said rotation control members are a stopper extending along the axial direction of said holder body being protrusively formed on the outer wall of said fitting portion of the holder body, and a groove for frictionally engaging with said stopper on the inner wall surface of said cap body along the periphery thereof.

6. A spare lead holder as claimed in claim 3 wherein said rotation control members are a stopper being protruded on the wall in the front end portion of said fitting portion of said holder body along the axial direction thereof, and a groove for frictionally engaging with said stopper being provided on the top wall of said cap body along the periphery thereof.

7. A spare lead holder as claimed in claim 3 wherein said rotation control members are a stopper extending shortly along the axidal direction of said holder body being protrusively formed on the rear end portion of said fitting portion of said holder body, and a groove for frictionally engaging with said stopper being formed on the inner wall of the rear end portion of said cap body along the circumferential surface thereof.

8. A spare lead holder as claimed in claim 3 wherein said rotation control members are a groove extending shortly along the axial direction of said holder body being formed on a portion of the periphery of said fitting portion of said holder body, and a stopper being inwardly protruded on a portion of said cap body.

9. A spare lead holder as claimed in claim 1:

(a) wherein said means for limiting rotational motion of said cap body comprises a notch provided on the outer circumference of said open end portion of said holder body at a point symmetry position relative to said longitudinal groove; and (b) wherein said cap body includes a projection projecting inwardly of said cap body and receivable within said notch.

* * * * *